US006533143B1

(12) United States Patent
Yaguchi

(10) Patent No.: US 6,533,143 B1
(45) Date of Patent: Mar. 18, 2003

(54) MULTIPLE FILLING DEVICE FOR POWDER MATERIALS

(75) Inventor: Shouichi Yaguchi, Kanagawa (JP)

(73) Assignee: Sanko Machinery Co., Ltd., Sagamihara (JP)

( * ) Notice: Subject to any disclaimer, the term of this patent is extended or adjusted under 35 U.S.C. 154(b) by 0 days.

(21) Appl. No.: 09/849,267

(22) Filed: May 7, 2001

(51) Int. Cl.[7] ..... B67D 5/52
(52) U.S. Cl. ..... 222/135; 222/241; 222/413
(58) Field of Search ..... 222/135, 239, 222/241, 413

(56) References Cited

U.S. PATENT DOCUMENTS 3,159,290 A * 12/1964 Hesse ..... 222/135
3,658,212 A * 4/1972 Ullberg ..... 222/241
4,151,932 A * 5/1979 Wachtler ..... 222/241
6,033,105 A * 3/2000 Barker et al. ..... 222/241
6,237,815 B1 * 5/2001 Schlosser ..... 222/241

FOREIGN PATENT DOCUMENTS

JP U-S58-54327 9/1980
JP A-H9-272511 10/1997

* cited by examiner

*Primary Examiner*—Joseph A. Kaufman
(74) *Attorney, Agent, or Firm*—Armstrong, Westerman & Hattori, LLP

(57) ABSTRACT

A multiple filling device having a hopper, multiple supply nozzles each having a rotating sleeve for transferring rotational movement to a feeding screw to distribute content material stored in a divided portion of the hopper. The rotating sleeve is motivated by a driving motor. A main driving motor is also rotatably connected to multiple agitating blades each residing inside the divided portion.

2 Claims, 3 Drawing Sheets

MULTIPLE FILLING DEVICE FOR POWDER MATERIALS

BACKGROUND OF THE INVENTION

1. Field of the Invention

This invention relates to a multiple-line automatic packaging machine capable of automatically and continuously form-fill-sealing multiple stick-like packages at a time, and more particularly to a multiple filling device suited to be used for such a multiple-line automatic packaging machine.

2. Brief Description of the Prior Art

A typical conventional automatic packaging machine comprises the steps, as discussed for example in Japanese Utility Model Publication No. 54327/1983 and Japanese Patent Publication No. 272511/1997, for slitting a rolled-up packaging material consisting of a wide sheet film which is uniformly printed into a predetermined number of parts, sealing the packaging material (i.e., packaging film) vertically and then horizontally, filling material to be packaged (i.e., content material) into the packaging film and cutting the packaging film, all in a continuous manner. For filling content material, a conventional automatic packaging machine generally uses a multiple-line auger filling device such as the one illustrated in FIG. 3.

In FIG. 3, reference numeral 20 denotes a hopper made into laterally long shape to hold content material. 21R . . . denotes supply nozzles of small in diameter, each is fixed vertically at the bottom of the hopper 20 at an equal distance between them. 21 . . . denotes rotating shafts, each is fixed inside the hopper 20 and separated at an equal distance therebetween, with its lower end goes inside of the supply nozzles 21R . . . respectively. 21M . . . denotes driving motors for the rotating shafts 21 . . . each is mounted on the upper plate 22 located over the hopper 20. 21S . . . denotes feeding screws, each is fixed to the respective rotating shafts 21. 20X denotes a cover to the hopper 20. As illustrated, the hopper 20 holds content material P in its inside 20H. When rotating shafts 21 are driven by respective driving motors, feeding screws 21S . . . take content material P into supply nozzles 21R . . . and then, content material P is fed, through respective supply nozzles 21R . . . , into the packaging film which is formed and sealed into multiple tubes (not shown).

However, it is not suitable to use a conventional multiple-line automatic packaging machine as described above for packaging certain types of content material P, for example, powdery material like milk powder or fragile granules. The reason is that, when feeding screws 21S . . . rotate in one direction, content material P gradually moves to one side of the hopper 20 and becomes blocks there, causing problems like uneven flow of content material P into respective supply nozzles 21R . . . resulting in unacceptable packages made with content material less than the specified volume or weight, or granular content material P ground to powder resulting in unacceptable packages made with content material out of specifications.

Therefore, the technical theme of present invention is to offer a multiple filling device designed, when content material is fed to a multiple-line automatic packaging machine through multiple supply nozzles fixed in parallel, to agitate content material held in the hopper to prevent it from becoming blocks and to ensure its uniform supply into respective supply nozzles and that, without having it ground to powder.

SUMMARY OF THE INVENTION

The object of the present invention is to provide those two items of claim discussed below to the multiple filling device comprising a hopper made into laterally long shape, having multiple supply nozzles vertically fixed at its bottom at an equal distance between them, multiple rotating shafts with feeding screws inside the hopper, each goes into the respective supply nozzles, and driving motors. The multiple filling device is designed to have each rotating shaft rotate by respective driving motors, thus content materal held in the hopper is taken by the feeding screws into respective supply nozzles and is fed downward.

(1) To divide the inside of the hopper, at least at its bottom area, according to the number of rotating shafts, by means of walls on the borders of the divided portions as if making multiple rooms with their tops open, and provide an agitating blade in each divided portion to be rotated by a motor. (claim 1)

(2) To design a mechanism to enable multiple agitating blades, provided in respective divided portions, to be rotated by one driving motor in the reverse direction to that of the rotating shaft. (claim 2)

1. Owing to the features of claim 1 discussed in above (1), inner bottom area of the hopper holding content material is divided according to the number of rotating shafts into multiple divided portions with their tops open. An agitating blade rotates in each divided portion to agitate content material. Because of these features, therefore, content material does not move to one side of the hopper and become blocks there, but is fed uniformly into respective supply nozzles according to the rotations of feeding screws. Further, granular content material is not ground to powder, ensuring that it is packaged keeping its quality and shape.
2. Owing to the features of claim 2 discussed in above (2), all those multiple agitating blades provided in respective divided portions are rotated by one driving motor, enabling to simplify the structure of the multiple feeding device and to reduce its production cost. Further, since each agitating blade rotates in a reverse direction to that of the feeding screw, it surely prevents content material from moving to one side of the hopper, or from becoming blocks, or from being ground to powder. Because of these features, therefore, it ensures uniform feeding of content material into all of the supply nozzles and increase the accuracy of content material filled in each package.

DETAILED DESCRIPTION OF THE INVENTION

The preferred embodiment of a multiple filling device of the present invention is described in detail with reference to the several sheets of the accompanying drawings.

Figure 1:
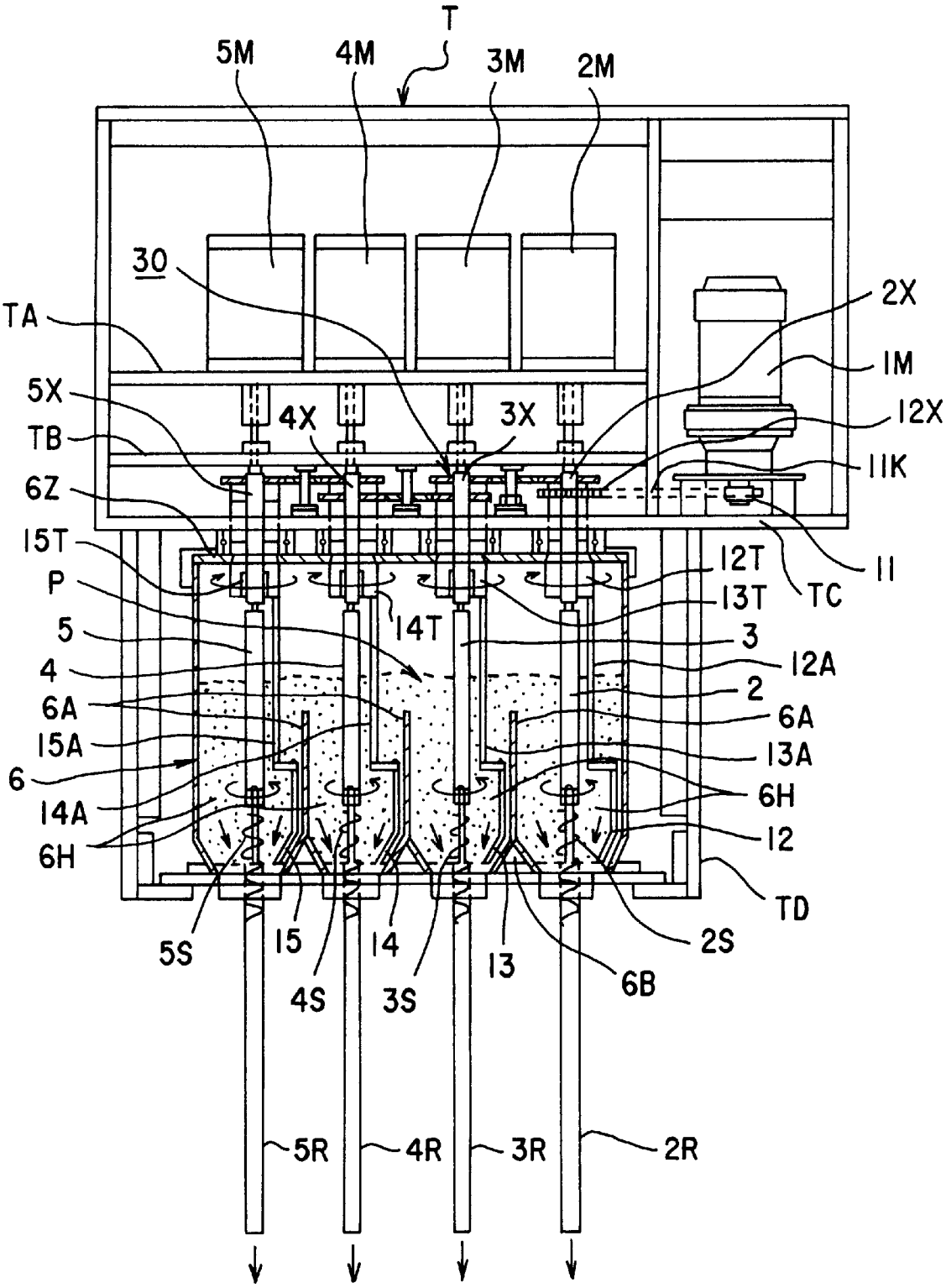
FIG. 1 is a front view, partially cross section, showing the structure of the multiple feeding device of the present invention.
Figure 2:
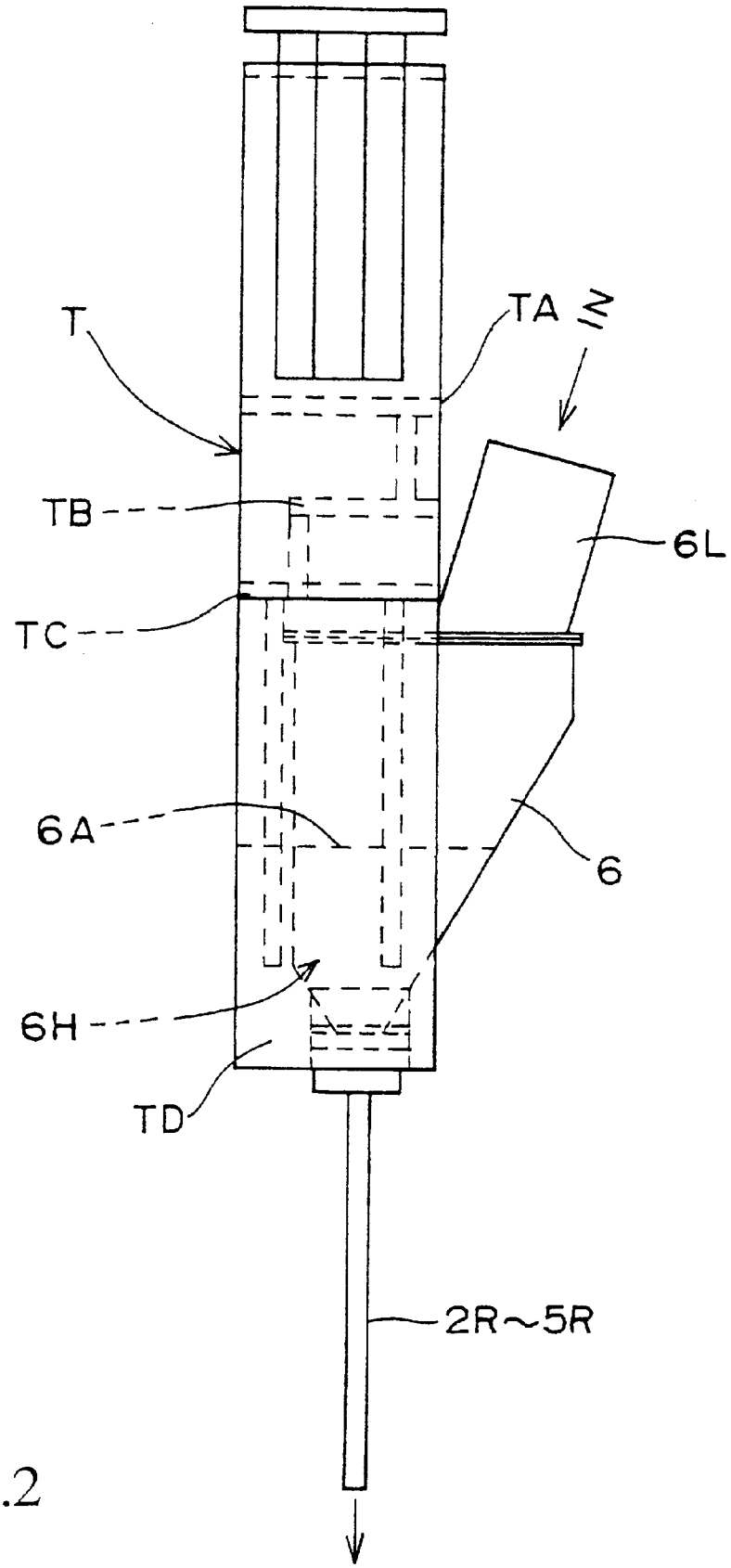
FIG. 2 is a side view of the present invention.
Figure 3:
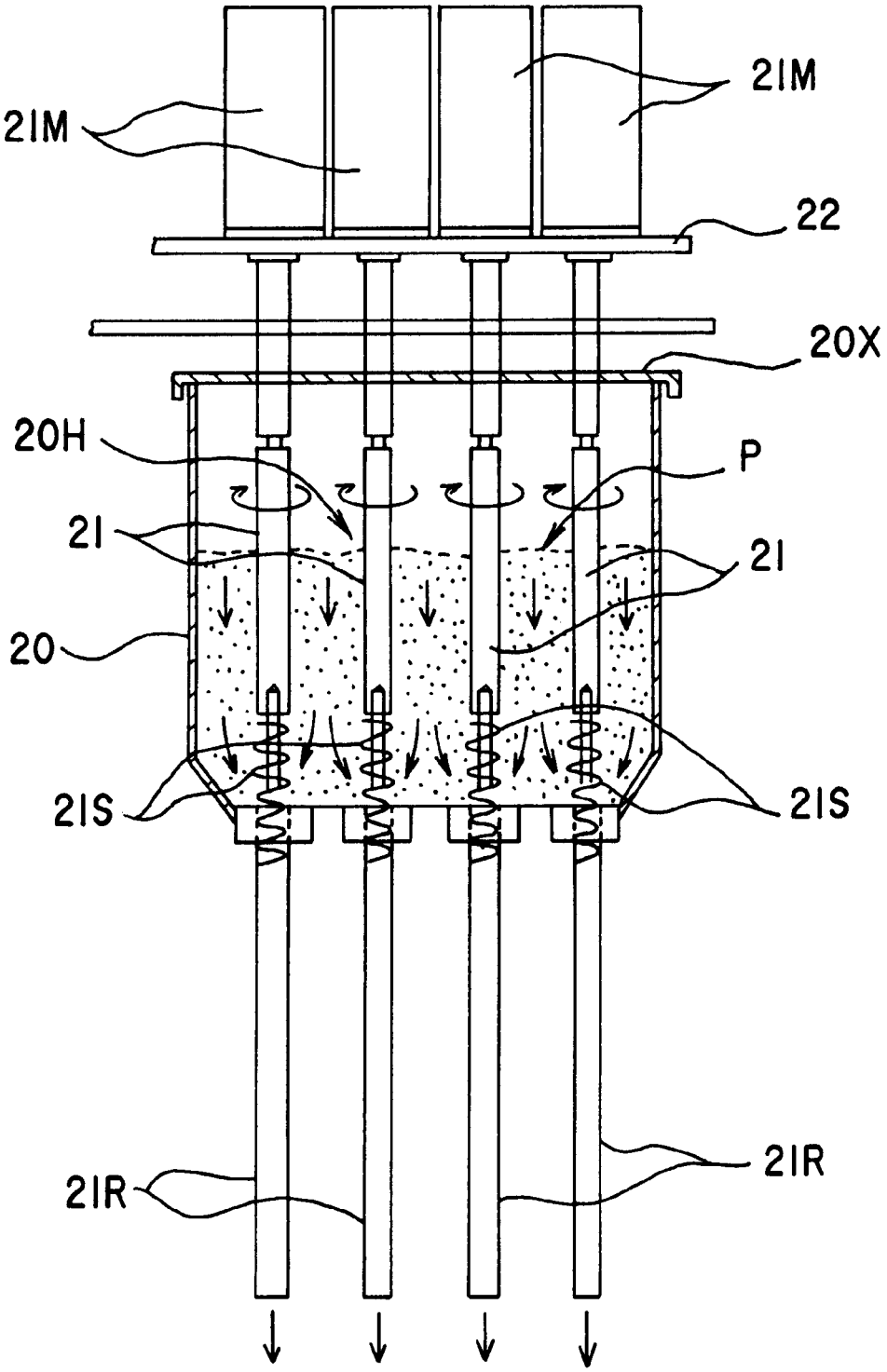
FIG.3 PRIOR ART
FIG. 3 is a front view, partially cross section, showing the structure of the conventional multiple feeding device.

FIG. 1 is a front view, partially cross section, showing the entire structure of the present invention and FIG. 2 is its side view. In these figures, reference character TD denotes a support frame to support the hopper 6 which is made into laterally long shape to hold content material. TC denotes a cover plate to the support frame TD. T denotes a main frame fixed on the cover plate TC. TA and TB denote respective mounting plates, each is horizontally fixed inside of the main frame in parallel with a space between them. 2R, 3R, 4R and 5R denote respective supply nozzles fixed vertically at the bottom of the hopper 6 at an equal distance between them.

Reference numeral 6A and 6B denotes vertical walls on top of V-formed walls to divide inside of the hopper 6, at least at its bottom area by the number of rotating shafts 2, 3, 4 and 5, into divided portions 6H with their tops open. At the center of each divided portion 6H, each of the rotating shafts 2 through 5 is vertically fixed.

Reference numerals 12, 13, 14 and 15 denote agitating blades fixed in respective divided portions 6H . . . Each of the agitating blades 12 through 15 rotates inside of respective divided portions 6H . . . in the reverse direction to that of respective rotating shafts 2 through 5, namely, respective feeding screws 2S through 5S, to prevent content material P in respective divided portions 6H . . . from moving to one side of the hopper and becoming blocks, and granules from being ground to powder.

In FIG. 1, reference numerals 12T, 13T, 14T and 15T denote rotating sleeves for agitating blades, each is fixed at the upper part of respective rotating shafts 2, 3, 4, and 5 but moves independent of rotating shafts. To respective rotating sleeves 12T through 15T, holding arms 12A, 13A, 14A and 15A are fixed and at the lower end of respective holding arms, each of rotating blades 12 through 15 is fixed. In the space provided between the mounting plate TB and cover plate TC, interlocked driving gears 30 are encased to rotate all of the rotating sleeves 12T through 15T by means of one motor 1M equipped at one side of the main frame T.

Further, in FIG. 1, reference numeral 11 denotes a driving pulley for the driving motor 1M for agitating blades, 12X denotes an interlocked pulley fixed to the interlocked driving gears 30. 11K denotes a driving belt tying both pulleys 11 and 12X. In FIG. 2, reference numeral 6L denotes a supply port to supply content material P into the hopper 6.

As apparent from the above, according to the multiple filling device of the present invention, content material P supplied to and held in the hopper 6 is agitated by respective agitating blades 12 through 15 by means of the driving motor 1M. While doing so, by rotating respective feeding screws 2S through 5S together with respective rotating shafts 2 through 5 by means of respective driving motors 2M through 5M, content material P can be fed into respective supply nozzles 2R through 5R and then, for example, into the packaging film which is formed and sealed into multiple tubes by a multiple-line automatic packaging machine.

Further, according to the present invention, the inner bottom area of the hopper 6 is divided by the number of rotating shafts 2 through 5 and by means of walls, into divided portions 6H . . . with their tops open. In each divided portion, respective agitating blades 12 through 15 rotate in the reverse direction to that of respective feeding screws 2S through 5S. Therefore, content material P in the hopper 6 is agitated constantly and uniformly without moving to one side of the hopper 6 or becoming blocks or being ground to powder. All these features ensure uniform volume of content material P is smoothly fed into respective supply nozzles 2R through 5R according to the rotations of respective feeding screws 2S through 5S.

In FIG. 1, a multiple filling device with four (4) supply nozzles 2R through 5R is shown as one of the examples. The preferred embodiment herein described is not intended to be exhaustive or to limit the invention to the precise from disclosed. It is chosen and described to explain the principles of the invention, its application and its practical use to enable others skilled in the art to utilize the invention.

Moreover, according to the multiple feeding device of the present invention, content material held in the hopper can be uniformly fed into multiple supply nozzles without moving to one side of the hopper or becoming blocks or being ground to powder. The multiple feeding device of the present invention can exhibit its significant effect when it is applied to a multiple-line automatic packaging machine for continuously packaging certain types of content material such as those which are apt to become blocks like milk powder for example, or fragile granules which are apt to be ground to powder in the process of feeding.

What is claimed is:

1. A multiple filling device for powder materials comprising:

a hopper made into a laterally long shape with a hopper height, having multiple supply nozzles vertically fixed at its bottom at an equal distance between them, multiple rotating shafts with feeding screws inside the hopper, each goes into the respective supply nozzles, driving motors to have respective rotating shafts rotate thus content material held in the hopper is taken by the feeding screws into respective supply nozzles and is fed downward;

wherein at least the inner bottom area of the hopper is divided by a plurality of vertical walls each positioned on top of a V-formed wall into divided portions, each enclosing respective rotating shafts, and an agitating blade is fixed in each divided portion; and wherein each of the plurality of vertical walls has a wall height shorter than the hopper height.

2. A multiple filling device as defined in claim 1, wherein the agitating blades in respective divided portions are rotated by one motor in the reverse direction to that of feeding screws.

* * * * *